United States Patent [19]

Boyle

[11] 4,445,692

[45] May 1, 1984

[54] BOARD GAME INVOLVING INTERNATIONAL TRADE

[76] Inventor: Walter G. Boyle, 10 Centrepark Dr., Ottawa, Ontario, Canada, K1B 3C1

[21] Appl. No.: 330,236

[22] Filed: Mar. 2, 1982

[51] Int. Cl.[3] ..... H63F 3/00

[52] U.S. Cl. ..... 273/256

[58] Field of Search ..... 273/256, 257, 243, 244

[56] References Cited

U.S. PATENT DOCUMENTS

| | | | |
|---|---|---|---|
| 2,717,157 | 9/1955 | Dylewski | 273/257 X |
| 3,643,958 | 2/1972 | Sperber | 273/257 |
| 3,756,604 | 9/1973 | Laszlo | 273/255 |
| 3,961,795 | 6/1976 | Anspach | 273/256 |
| 4,032,154 | 6/1977 | Magiera | 273/256 |
| 4,299,390 | 11/1981 | Delgado | 273/257 |

FOREIGN PATENT DOCUMENTS

| | | | |
|---|---|---|---|
| 2078118 | 1/1982 | United Kingdom | 273/256 |

*Primary Examiner*—Richard C. Pinkham
*Assistant Examiner*—Scott Brown

[57] ABSTRACT

An international trading name comprising a board with a continuous path divided into consecutive spaces having goods and services markings there along, group markings respectively associated with countries or groups of goods and services, opportunities and penalties for placing of tokens advanced randomly, a supply of opportunity and hazard cards (e.g. export inquiries, import inquiries, special opportunities, wheeling and dealing opportunities, all risk insurance policies, hazards) immitation money, agency agreement cards, playing pieces, dice to randomly select playing piece movements, tokens and flags to be placed on the board to identify the establishment by players of agents and trading houses around the world.

5 Claims, 14 Drawing Figures

AGENCY AGREEMENT

COUNTRY

SAUDI ARABIA

PRODUCT/ COMMODITY/ SERVICE/

FINANCIAL SERVICES

AGENCY AGREEMENT COST:

| | |
|---|---|
| TRAVEL & ENT. | $6,000 |
| LEGAL EXP. | — |
| ADV. COSTS | 1,000 |
| MISC. | 3,000 |
| TOTAL | $10,000 |

TRADING HOUSE INVEST.

COST $20,000

FIG- 7

IMPORT FILE

| PRODUCT COMMODITY SERVICE | COUNTRY | COMM. |
|---|---|---|
| TOYS & GAMES | HONG KONG | $35,000 |
| TRANS. EQT. | U.S.A. | $30,000 |
| OLIVES | SPAIN | $15,000 |
| WHISKEY | BRITAIN | $10,000 |
| COAL | AUST. | $35,000 |

FIG- 9

EXPORT ENQUIRIES

| PRODUCT COMMODITY SERVICE | COUNTRY | COMM. |
|---|---|---|
| CHROME | TURKEY | $20,000 |
| GOLD | S.A. | $30,000 |
| TEA | INDIA | $15,000 |
| SULPHUR | CANADA | $20,000 |
| IVORY | GABON | $30,000 |

FIG- 8

SPECIAL

OPPORTUNITY

YOU ARE INFORMED THAT THERE IS A LARGE BLACK MARKET IN MAINLAND CHINA FOR MODERN STYLED SUNGLASSES. IF YOU HAVE AGENTS IN:

FRANCE

&

HONG KONG

COLLECT $50,000 FROM THE BANK

FIG- 10

INTL. WHEELING AND DEALING

THE FREEDOM AND SECURITY OF NORTH AMERICA AS A HAVEN FOR THEIR CASH LURES SINGAPORE'S APARTMENT INVESTORS. IF YOU ARE REPRESENTED IN:

CANADA

SINGAPORE

CARIBBEAN

COLLECT $300,000 FROM THE BANK

FIG-11

NON INSURABLE

HAZARD

DELAYS RESULTING FROM A COMPETITOR'S INFLUENCE ON SUSCEPTIBLE OFFICIALS IN AN OVERSEAS COUNTRY IMPOSE A HEAVY LOSS FOR YOU.

PAY $35,000 TO THE BANK

FIG-13

ALL-RISK

INSURANCE POLICY

VALID FOR ONE TRIP

AROUND THE BOARD

PREMIUM $10,000

FIG-12

BOARD GAME INVOLVING INTERNATIONAL TRADE

BACKGROUND OF THE INVENTION

1. Field of the Invention

This invention relates to a board type game and particularly to a board type game wherein the object is to acquire the greatest amount of simulated wealth.

2. Brief Description of the Prior Art

Board games and particularly those of the general character described have become increasingly popular. In a typical acquisition game there is provided a plurality of playing pieces, one for each player, a game board, a chance device and simulated money. The game board has a playing surface on which the playing pieces are supported. A plurality of stations are printed on the playing surface and define a path of travel for the playing pieces. At least some of the stations are acquisition stations which have indicia representative of an acquisition, such as property. The chance device determines the number of stations a particular playing piece shall advance on the playing surface. The simulated money which is acquired during the play of the game provides a means of acquiring a particular representative acquisition whenever a player's piece lands on an acquisition station.

Many of the types of games above described may also include a set of chance cards having indicia thereon representative of an advantage one player may exercise over another player or a hazard that a player must suffer in relation to other players.

OBJECTS OF THE INVENTION

1. To provide a new educational and entertaining trading and investment type board game.

2. To provide a game with global appeal, one in which people of all the free nations of the world can relate.

3. To provide a game apparatus that permits a great variety of plays or opportunities simulating many of the transactions and effects commonly encountered in international trade, in a manner to show their relationship for example exporting, importing, receiving inquiries and sourcing goods through a network of agents and trading houses and various hazards and pitfalls to be avoided.

4. To provide an international trading game having the advantageous characteristics mentioned in the preceding paragraph which is extremely simple in construction and use, capable of being played by persons of widely differing ages and intellectual levels and which is well adapted to meet practical conditions of manufacture, distribution and use.

5. Other objects of the present invention will become apparent upon reading the following specification and referring to the accompanying drawings, which form a material part of the disclosure. The invention accordingly consists in the features of construction, combinations of elements and arrangement of parts, which will be exemplified in the construction herein after described, and of which the scope will be indicated by the appended claims.

SUMMARY OF THE INVENTION

The foregoing objects are achieved by a square board having marked spaces providing a continuous path extending about the board. Each of the spaces have designations for countries, goods and services, financial services, agency locations, trading house locations, special opportunities, wheeling and dealing opportunities, hazards, export tax, free all risk insurance and start. At the center of the board, spaces are provided for the placement of a plurality of draw cards.

A plurality of agency agreement cards are provided, each having data thereon expressing values applicable to the above mentioned agency and trading house locations.

A plurality of special opportunity cards are also provided, each card having data of special world trade opportunities requiring ownership of two specified agency agreements.

A plurality of wheeling and dealing opportunity cards are also provided, each card having data of ultra special world trade opportunities requiring ownership of three specified agency agreements.

A plurality of export inquiry cards are also provided, each card having data of export opportunities.

A plurality of import inquiry cards are also provided, each card having data on imports.

A plurality of hazard cards are provided, each card having data imposing penalties, both insurable and non-insurable, related to the many hazards and pitfalls of international trade.

A plurality of all risk insurance policy cards are provided, each card having data providing protection from all insurable risks of international trade.

The game also includes a plurality of playing pieces of different colors.

Thus each player is identified by a particular color.

A plurality of agency tokens are also provided, there being a plurality of tokens of a particular color which corresponds to the color of a playing piece. Thus for each playing piece there is a group of agency agreement tokens of the same color. When a player acquires an agency agreement as determined by the preferred rules of the game, he or she places one of the agency agreement tokens on the board space alloted to the acquired agency to indicate ownership thereof.

A plurality of trading house flags are also provided, there being a plurality of flags of a particular color which corresponds to the color of a playing piece. Thus for each playing piece there is a group of trading house flags of the same color. When a player acquires a trading house as determined by the preferred rules of the game he or she places one of the trading house flags on the board space alloted to the country in which the trading house is located to indicate ownership thereof. The complete game will also include a complete set of rules under which it is to be played. Such rules, of course, are subject to variation within the broad principles on which the game is founded.

For a full and more complete understanding of the game, reference may be had to the following description and accompanying drawings wherein:

FIG. 7 is a view of a typical agency agreement card.

FIG. 8 is a view of a typical export inquiry card.

FIG. 9 is a view of a typical import file card.

FIG. 10 is a view of a typical special opportunity card.

FIG. 11 is a view of a typical wheeling and dealing in world trade opportunity card.

FIG. 12 is a view of a simulated all risk insurance policy.

FIG. 13 is a view of a typical hazard card.

DESCRIPTION OF THE PREFERRED EMBODIMENT

Figure 1A:
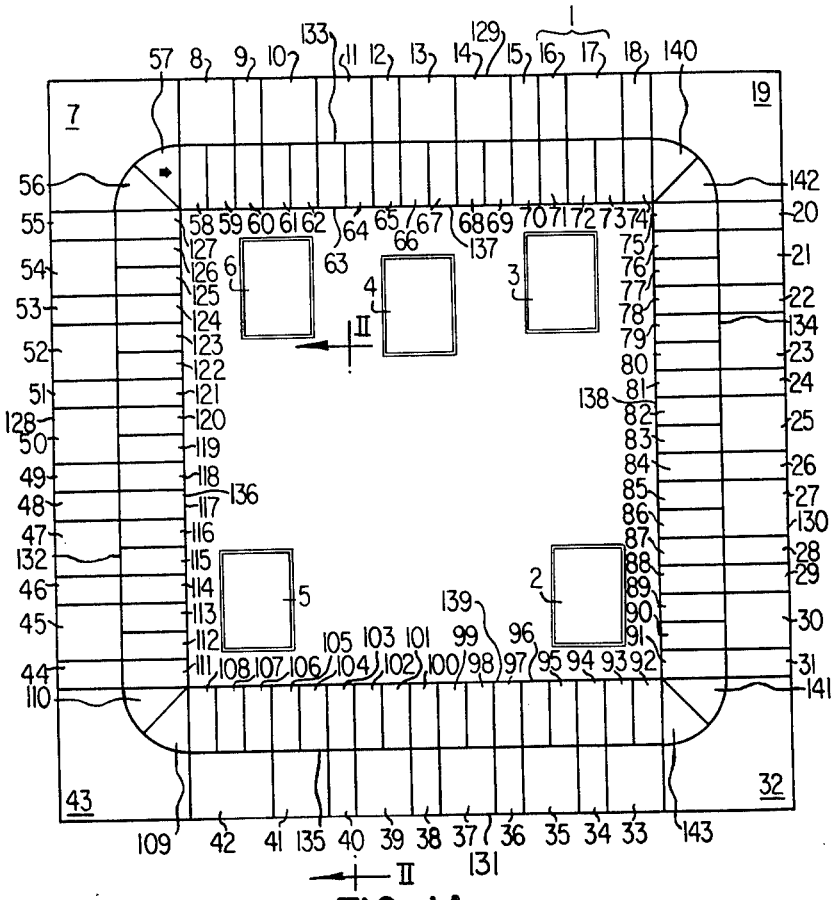
FIG. 1A is a schematic view of the game board plan or playing field for the game.

Referring now to the drawings, more particularly to FIG. 1A, a schematic planned view of the playing board is therein illustrated and identified in its entirety by the reference character 1. The board 1 may be of any appropriate material with a good grade of cardboard being indicated as the preferred material. Board 1 is square and presents side edges 128, 129, 130 and 131. Extending from side edge 128 to side edge 130 are innerlines 137 and 139 which are parallel to two side edges 129 and 131 respectively while additional inner lines 136 and 138 extend between side edges 129 and 131 being parallel to side edges 128 and 130.

Lines 128, 136, 129 and 137 define a corner square 7 start which is divided into two playing spaces free insurance 56 and start 57. Lines 129, 137, 130 and 138 define a corner square 19 which is marked international wheeling and dealing and is divided into two playing spaces 142 and 140 both marked opportunity. Lines 130, 138, 131 and 139 define a corner square 32 which is marked export tax and is divided into two playing spaces 141 and 143 both marked tax. Lines 131, 139, 136 and 128 define a corner square 43 marked international wheeling and dealing and is divided into two playing spaces 109 and 110 both marked opportunity.

The path or course made up of 76 playing spaces or areas 57 through 127 plus 140, 141, 142 and 143 extends entirely about the board thus constituting a continuous path or playing area about which the tokens of the players are moved according to the throws of the dice.

The space between lines 137 and 129 is divided into 12 major headings 8 through 18 and 17 playing spaces 58 through 74. Of the 17 playing sections, 70 and 74 are marked hazard, 60 and 71 are marked freelance agent and 65 is marked associate international finder. The remaining 12 playing spaces are marked with designations of various goods and services and identified as being related to one of the countries indicated in 6 of the 12 major headings.

The space between lines 130 and 138 is divided into 12 major headings 20 through 31 and 17 playing sections 75 through 91. Of the 17 playing sections 75 and 84 are marked freelance agent, 78 and 88 are marked associate international finder and 81, 87 and 91 are marked hazard. The remaining 10 playing spaces are marked with designations of various goods and services and identified as being related to one of the countries indicated in 5 of the 12 major headings.

The space between lines 131 and 139 is divided into 10 major headings 33 through 42 and 17 playing spaces 92 through 108. Of the 17 playing sections 94 and 103 are marked freelance agent, 97 is marked associate international finder and 100 is marked hazard. The remaining 13 playing spaces are marked with designations of various goods and services and identified as being related to one of the countries indicated in 6 of the 10 major headings. The space between lines 128 and 136 is divided into 12 major headings 44 through 55 and 17 playing spaces 111 through 127. Of the 17 playing sections 118 and 127 are marked freelance agent, sections 114 and 121 are marked associate international finder and 111, 117 and 124 are marked hazard. The remaining 10 playing spaces are marked with designations of various goods and services and identified as being related to one of the countries indicated in 5 of the 12 major headings.

In the center of the playing board are provided five areas 2,3,4,5 and 6 for the placing of special opportunity draw cards, export inquiry draw cards, hazard draw cards, international wheeling and dealing draw cards and import file draw cards respectively.

It is to be understood that the invention is not limited to any particular number of areas or playing spaces.

Figure 1B:
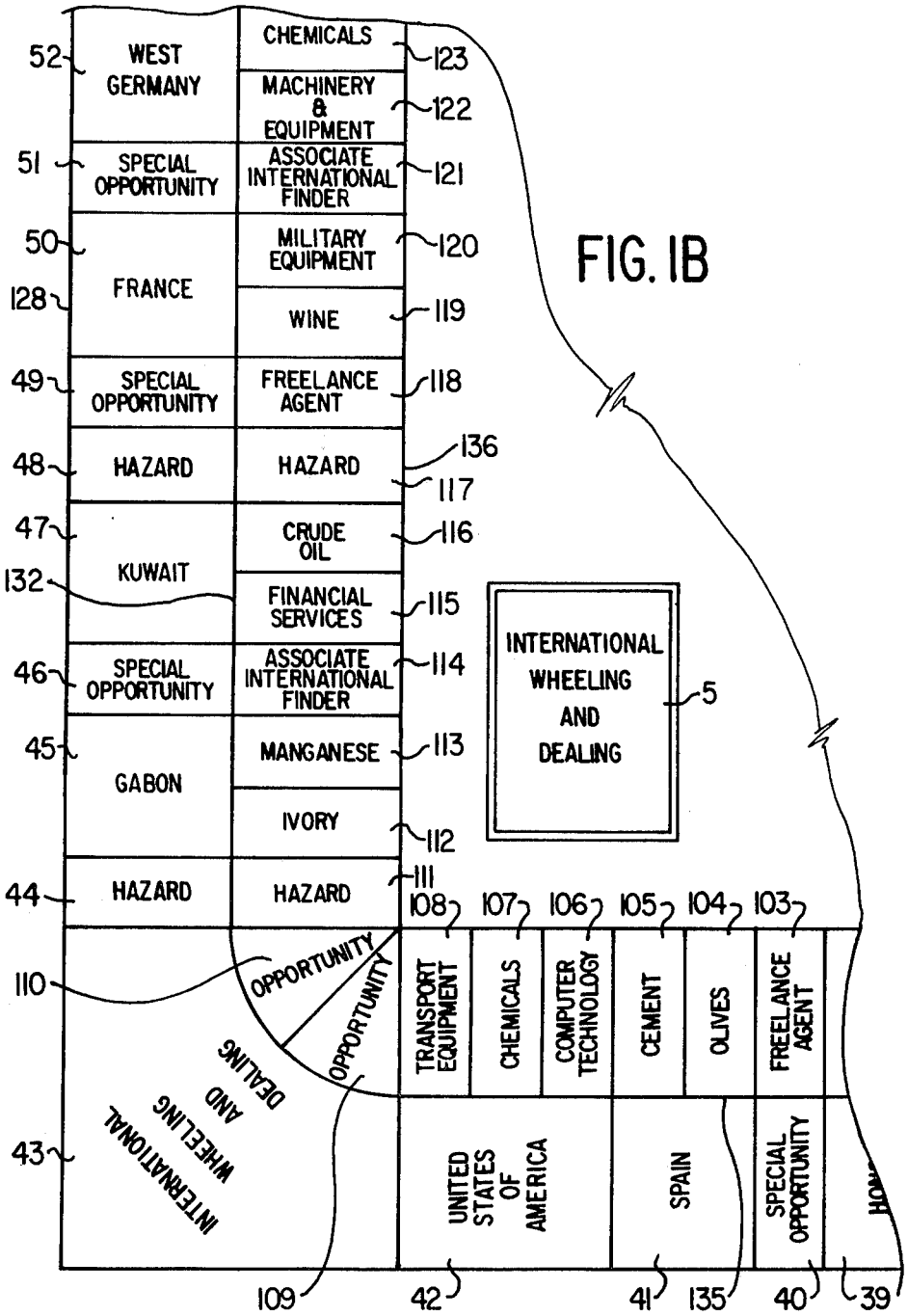
FIG. 1B is an enlarged fragmentary detail view of the game board taken on line II—II of FIG. 1A.

Referring now to FIG. 1B, an enlarged fragmentary detail view of the gameboard is shown, taken on line II—II of FIG. 1A.

Figure 2:
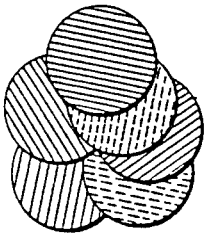
FIG. 2 is a view of tokens that are used to designate the establishment of agency agreements by players.

Referring now to FIG. 2, a plurality of agency agreement chips are provided. The chips are of different colors with each color being the same as that of a playing piece to be later described.

Figure 3:
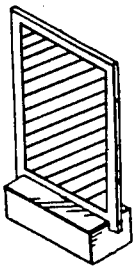
FIG. 3 is a view of flags or other insignia used to designate the establishment of trading houses by players.

Referring now to FIG. 3, a plurality of trading house flags or other insignia are provided. The flags are of different colors with each color being the same as that of a playing piece to be later described.

Figure 4:
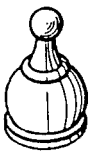
FIG. 4 is a view of the playing piece used to represent players movements according to the throw of the dice.

Referring now to FIG. 4, a plurality of playing pieces are provided. The playing pieces are of different colors with each color being the same as that of a plurality of agency agreement chips and trading house flags.

Figure 5:
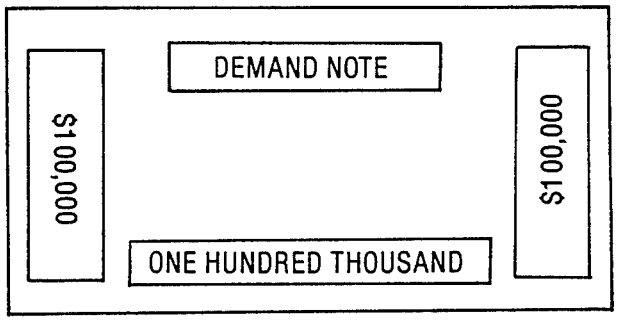
FIG. 5 is a view of the play money used.

Referring now to FIG. 5. The game provides a plurality of play money in various denominations in quantities which are ample for playing the game in accordance with the rules to be hereafter set forth. Purely by way of example FIG. 5 is shown as comprising a ten thousand dollar bill.

Figure 6:
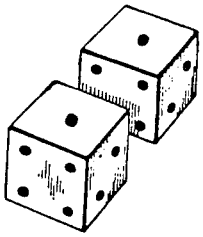
FIG. 6 is a view of the dice used to determine by chance a player's movements around the board.

Referring now to FIG. 6, any suitable chance determining element or means may be provided, such, for example as the two dice represented in FIG. 6. Instead any other suitable chance determining element or device may be employed, as, for example, an arrow or pointer pivoted to be spun.

Referring to FIG. 7, a plurality of agency agreement cards are provided there being 45 in number, and therefore corresponding to the number of agents representing various goods and services on the board. The same names of countries, goods and services, etc. appear respectively upon the said agency cards and the same coloring is indicated on those cards as on the corresponding agency and country locations on the board 1. In addition, each card sets forth the cost of establishing the agency and setting up a trading house according to the preferred rules of the game.

Referring now to FIG. 8, a plurality of export inquiry cards are provided, each card having data of five or more export opportunities. In addition each card sets forth the commission to be received by players according to the preferred rules of the game.

Referring now to FIG. 9, a plurality of import inquiry cards are provided, each card having data of five or more import requests. In addition, each card sets forth the commission to be received and paid by players according to the preferred rules of the game.

Referring now to FIG. 10, a plurality of special opportunity cards are provided there being 50 or more in number, each card having data of special world trade opportunities requiring ownership of two specified agency agreements. In addition, each card sets forth the commission to be received by players according to the preferred rules of the game.

Referring now to FIG. 11, a plurality of wheeling and dealing opportunity cards are provided there being 25 or more in number, each having data of ultra special world trade opportunities requiring ownership of three specified agency agreements, in addition, each card sets forth the commission to be received by players according to the preferred rules of the game.

Referring now to FIG. 12, a plurality of hazard cards are provided each card having data imposing penalties both insurable and non insurable related to the many hazards and pitfalls of international trade.

Referring now to FIG. 13, a plurality of all risk insurance policy cards are provided each card having data providing protection from all insurable risks of international trade. In addition each card sets forth cost of purchasing said insurance.

RULES OF THE GAME AND METHOD OF PLAY

1. Preparation

The board is placed within view of all players with the export inquiry cards, import file cards, special opportunity cards, wheeling and dealing cards and hazard cards face down on the space provided on the board. Each participating player selects one of the tokens and places it within the starting space. Each player receives a sum of immitation money according to the number of players as follows:

Two players: $200,000 each
Three players: $150,000 each
Four players or more: $100,000 each The banker shuffles the deck of agency agreement cards and deals each player agency agreement cards according to the number of players as follows:

Two players: Seven cards each
Three players: Five cards each
Four players: Four cards each Each player receiving agency agreement cards immediately pays the bank the indicated value thereof.

2. General Rules

The object of the game is to make money by trading in goods and services of all kinds through a network of agents and trading houses established around the world. The player accumulating the greatest amount of wealth at the end of the game is the winner.

Two or more players, up to 6 may participate. The playing order is determined by throwing the dice. The player receiving the highest total plays first and the other players following clockwise in order. The first player to the left of the player playing first is elected banker. The banker receives and distributes all monies with the exception of import commissions which are both paid and received directly by the players involved.

The banker maintains all agency agreement cards by issuing them to all buyers and receiving them from sellers.

3. The Play

Moving the tokens. The player whose turn it is throws the two dice and advances his token in the arrow direction the number of spaces shown on the dice.

Trading. Depending on where his token is placed as a result of the toss, a player may have the opportunity to:

1. establish an agency
2. establish a trading house
3. buy an all risk insurance policy or be obliged to:

1. draw an export inquiry card
2. drawn an import file card
3. draw a special opportunity card
4. draw a wheeling and dealing card
5. draw a hazard card
6. pay an export tax Players landing on unrepresented goods or services i.e. goods or service in a country where none of the players holds an agency agreement, have the opportunity of appointing an agent at the stated price.

Players appointing agents to represent all of the goods and services shown on the board for a particular country have the option, at anytime during the game, of establishing a trading house at the investment price indicated on the agency agreement cards.

The benefit of establishing a trading house, is that when either you or your opponent lands in a country where you operate a trading house, you are in a position to buy and sell goods and services handled by your agents in other countries, anywhere on the board, in order to furnish the goods and services requested on the export inquiry and import inquiry cards drawn.

Players landing on goods or services represented by an opponents agent are obliged to select a card from the top of the import inquiry file.

If the goods or service requested on the import inquiry file card match the goods represented by the opponents agency where the player landed, he is required to pay the commission associated with the product indicated on the card to the opponent holding the agency.

Players landing on goods or services represented by one of their own agents are obliged to select a card from the top of the export inquiry file.

If the goods or services requested on the export inquiry card match the goods represented by the players agent where the player landed, he or she will receive the commission indicated on the card from the bank.

Players landing on goods or services in a country where an opponent has established a trading house are obliged to select a card from the top of the import inquiry file.

If the goods or service requested on the import inquiry file card match the goods or services represented by a trading house or agent of the opponent anywhere on the board, he is required to pay the commission associated with the goods or services indicated on the card to the opponent operating the trading house.

Players landing on goods or services in a country where they have established a trading house are obliged to select a card from the top of the export inquiry file.

If the goods or services requested on the export inquiry file card match the goods or services represented by a trading house or agent established by the player anywhere on the board, he or she will receive the commission indicated on the card from the bank.

Players landing on areas of the board designated as freelance agent or associated international finder are required to select a card from the top of the special opportunity card file.

If the player is represented in the two countries as specified on the special opportunity card, he or she is in a position to make a sale and will receive the commission indicated on the card from the bank.

Players landing on the corner areas of the board designated as international wheeling and dealing are required to select a card from the top of the wheeling and dealing opportunity card file.

If the player is represented in the three countries as specified on the wheeling and dealing card, he or she is in a position to make a sale and will receive the commission indicated on the card from the bank.

A player may purchase an all risk insurance policy at any time during the game except when he or she has landed on a hazard area.

The insurance policy is valid for only one trip around the board and the policy must be either renewed at the indicated price or returned to the World Trade Bank each time the player passes the start position. This rule applies regardless of the point on the board which the player may have purchased the policy.

A player throwing doubles on the dice is allowed an additional throw after meeting the requirements of the first toss. A player may keep possession of the dice so long as he continues to roll doubles.

A player may borrow funds from the bank at any one time, an amount up to ½ the value of his business at cost. i.e. one half the investment in both agency agreements and trading houses in $20,000 units. All borrowings must be made through the bank. Loans may be repaid at any time plus a twenty-five percent interest charge as indicated on the loan certificate.

While the form of the invention described constitutes a preferred embodiment of the invention, it is to be understood that the invention is not limited to this precise form and that changes may be made therein without departing from the scope of the invention.

What is claimed is:

1. In a board game, a. a board having a playing surface;

b. a plurality of playing spaces constituting a continuous path, said spaces having designations for various countries, commodities, financial services, special opportunities, international wheeling and dealing opportunities, hazards, free insurance, export-import tax, associate international finders, freelance agents and start;

c. a plurality of agency agreement cards, each of which displays the country, goods and services represented and coloring corresponding to the country locations on the game board, there being an agency agreement card for each commodity and/or service within each country on the board, each card also sets forth the cost of establishing the agency and setting up a trading house in that country;

d. a plurality of export enquiry cards, each of which has designations corresponding to a plurality of designated spaces;

e. a plurality of import file enquiry cards, each of which has designations corresponding to a plurality of designated spaces;

f. a plurality of special opportunity cards each of which displays data on international trade opportunities correlated to multiple designated spaces;

g. a plurality of wheeling and dealing opportunity cards each of which displays data on international trade opportunities correlated to multiple designated spaces;

h. a plurality of hazard cards, each of which displays data imposing penalties, both insurable and noninsurable, related to the many hazards and pitfalls of international trade;

i. a plurality of all risk insurance policy cards each of which displays data providing protection from all insurable risks of international trade and the cost of purchasing said insurance;

j. a plurality of playing pieces of different colors;

k. a plurality of agency agreement chips; a plurality of trading house flags;

m. a supply of playing money, and n. chance device for determining the number of playing spaces over which a playing piece is moved.

2. The board game of claim 1 in which the playing surface of the board has an area marked thereon for the receiving of said export inquiry cards in stacked condition, said import file cards in stacked condition, said special opportunity cards in stacked condition, said wheeling and dealing cards in stacked condition and another area marked thereon for receiving said hazard cards in stacked formation.

3. The board game of claim 1 in which certain of the playing spaces and related major headings are designated by country, position or color so as to constitute a distinguishable group, there being a plurality of such groups, the board having indications of the goods and services handled by each said group, said sets of cards containing indicia corresponding to said groups and designated spaces within the groups, allowing players the opportunity to collect a commission when either they or an opponent lands on a board space owned by them and the draw card indicia corresponds to said space, or imposing the obligation to pay a commission on players landing on a space owned by an opponent and the draw card indicia corresponds to said space, and additional opportunity or obligation to players landing on said group locations where trading houses have been established, by permitting players to simultaneously make plural transactions based on plural draw card indicia corresponding to owned plural designated board spaces.

4. The board game of claim 3 in which players may increase their opportunity for profit through the acquisition of the plurality of available spaces in the same group, permitting the establishment of a trading house in that group, permitting simultaneously a multiplicity of transactions in one move of the playing piece, predicated on the plural draw card indicia corresponding to owned plural designated board spaces, said draw cards to be drawn by players as determined by chance.

5. The board game of claim 1 in which each of the said export enquiry and import enquiry cards indicates a commission which is related to goods or services requested therein.

* * * * *